US006505491B2

(12) United States Patent
Ochi et al.

(10) Patent No.: US 6,505,491 B2
(45) **Date of Patent: *Jan. 14, 2003**

(54) ROLLING MILL AND ROLLING-MILL TRAIN

(75) Inventors: Shigeharu Ochi, Niihama (JP); Hiroshi Fujiwara, Niihama (JP); Sho Inui, Tokyo (JP); Takaaki Toyooka, Handa (JP); Motoaki Itadani, Handa (JP); Akira Yorifuji, Handa (JP); Toshio Onishi, Handa (JP); Koji Sugano, Handa (JP); Yasuo Nishida, Handa (JP); Nobuki Tanaka, Handa (JP)

(73) Assignees: Sumitomo Heavy Industries, Ltd., Tokyo (JP); Kawasaki Steel Corporation, Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/782,513

(22) Filed: Feb. 14, 2001

(65) Prior Publication Data

US 2001/0027673 A1 Oct. 11, 2001

(30) Foreign Application Priority Data

Mar. 7, 2000 (JP) ..... 2000-061678

(51) Int. Cl.[7] ..... B21B 13/10
(52) U.S. Cl. ..... 72/224; 72/235; 72/249
(58) Field of Search ..... 72/224, 234, 235, 72/249

(56) References Cited

U.S. PATENT DOCUMENTS 6,216,520 B1 * 4/2001 Ochi et al. ..... 72/224

FOREIGN PATENT DOCUMENTS

| | | | | |
|---|---|---|---|---|
| DE | 3703756 | * | 8/1988 | 72/224 |
| JP | 58-25805 | * | 2/1983 | 72/235 |
| JP | 60-18208 | * | 1/1985 | 72/224 |
| JP | 1458037 | * | 2/1989 | 72/224 |

* cited by examiner

*Primary Examiner*—Ed Tolan
(74) *Attorney, Agent, or Firm*—Arent Fox Kintner Plotkin & Kahn, PLLC

(57) ABSTRACT

This invention provides a rolling mill and a rolling-mill train which are compact. Reducers to be coupled with them can be made compact. The inner surfaces of pipes to be rolled with the rolling mill and the rolling-mill train can be prevented from becoming squarish. The rolling mill comprises a plurality of rolls disposed symmetrically around the pathline of the rolling mill, an annular driving bevel gear of a large diameter for driving and rotating the rolls, an input-shaft mechanism for rotating the driving bevel gear, a plurality of transmission mechanisms disposed at regular intervals along the driving bevel gear, and a housing for holding them. The input-shaft mechanism (i) has an input shaft inserted in the housing from its outside and an input bevel gear of a small diameter mounted on the input shaft and engaging with the driving bevel gear and (ii) is disposed between two adjacent transmission mechanisms. With the input shaft disposed horizontally, the phase angle of the roll unit can be adjusted minutely.

7 Claims, 10 Drawing Sheets

ROLLING MILL AND ROLLING-MILL TRAIN

BACKGROUND OF THE INVENTION

The present invention relates generally to a rolling mill and a rolling-mill train and more particularly to a rolling mill and a rolling-mill train to roll workpieces into products such as steel bars, wires, and pipes. The word of "products" used in this specification means a concept including steel bars, wires, and pipes.

A multi-stage four-roll or three-roll rolling-mill train rolls a workpiece in four or three directions repeatedly, reducing its sectional area gradually, to form it into a desired shape of desired dimensions.

Typical four-roll rolling mills used in the above rolling is shown in FIGS. 9 and 10. In FIG. 9, an input shaft 101 drives four rolls 102, 103, 104, and 105. The input shaft 101 is coupled with one roll 102. Each of the four rolls 102, 103, 104, and 105 has bevel gears (102*b*, 103*b*, 104*b*, or 105*b* as the case may be) on both its sides. When the input shaft 101 turns the roll 102, the driving power of the input shaft 101 is transmitted to other rolls 103, 104, and 105 through the bevel gears 102*b*, 103*b*, 104*b*, and 105*b*.

FIG. 10 shows a four-roll rolling mill which is similar to the rolling mill of FIG. 9 but of which the rolls are slanted by 45° relatively to horizontality and verticality. Its input shaft protrudes diagonally upward. Accordingly a reducer to be coupled with the input shaft has to be tall and bulky, occupying a large space and increasing the equipment cost.

To increase the dimensional accuracy of products, it is effective to roll workpieces with a multi-stage rolling-mill train consisting of rolling mills which are arranged in tandem and of which the roll units have phase angles minutely different from one another.

In case of a stretch reducer for pipes in particular, the inner surfaces of pipes tend to become squarish or polygonal. Such tendency can be reduced considerably by adjusting its roll phase angles minutely and pipes with round inner surfaces can be produced.

In case of rolling mills in accordance with the prior art, if the roll phase angle of a rolling mill is changed, its reducer becomes bulky. If a rolling mill is given a housing of which the disposition can be changed to adjust the roll phase angle, its reducer becomes complex.

In view of the foregoing, the object of the present invention is to provide a rolling mill and a rolling-mill train which are compact. Reducers to be coupled with them can be made compact. The inner surfaces of pipes to be rolled with the rolling mill and the rolling-mill train can be prevented from becoming squarish.

SUMMARY OF THE INVENTION

According to the first aspect of the present invention, there is provided a rolling mill comprising (i) a roll unit including a plurality of rolls disposed symmetrically around the pathline of the rolling mill and (ii) a driving unit for driving and rotating the rolls. The driving unit has an annular driving bevel gear of a large diameter, an input-shaft mechanism for rotating the driving bevel gear, a plurality of transmission mechanisms disposed at regular intervals along the driving bevel gear and transmitting the rotation of the driving bevel gear to the rolls, and a housing for holding them. The input-shaft mechanism has an input shaft inserted in the housing from its outside and an input bevel gear of a small diameter mounted on the input shaft and engaging with the driving bevel gear. The input-shaft mechanism is disposed between two adjacent transmission mechanisms.

According to the second aspect of the present invention, there is provided the rolling mill of the first aspect, wherein each transmission mechanism comprises (i) a first transmission shaft on which mounted is a transmission bevel gear of a small diameter engaging with the driving bevel gear, (ii) a first cylindrical gear mounted on the first transmission shaft, (iii) a second transmission shaft coupled with a shaft of a roll, and (iv) a second cylindrical gear mounted on the second transmission shaft and engaging with the fist cylindrical gear.

According to the third aspect of the present invention, there is provided the rolling mill of the second aspect, wherein (i) the input shaft of the input-shaft mechanism takes the place of the first transmission shaft of one of the transmission mechanisms and is disposed in parallel with the second transmission shaft and (ii) the first cylindrical gear is mounted on the input shaft and engages with the second cylindrical gear of the second transmission shaft.

According to the fourth aspect of the present invention, there is provided the rolling mill of the third aspect, wherein a first bevel gear takes the place of the first cylindrical gear of the input shaft and a second bevel gear takes the place of the second cylindrical gear of the second transmission shaft.

According to the fifth aspect of the present invention, there is provided a rolling-mill train comprising a plurality of rolling mills of the first aspect. Their input shafts are disposed horizontally and the phase angles of their roll units are different from one another.

According to the sixth aspect of the present invention, there is provided a rolling-mill train comprising a plurality of rolling mills of the fourth aspect. Their input shafts are disposed horizontally and the phase angles of their roll units are different from one another.

According to the seventh aspect of the present invention, there is provided a rolling-mill train comprising the rolling mill of the third aspect with its input shaft disposed horizontally, the rolling-mill train of the fifth aspect, and the rolling-mill train of the sixth aspect all arranged in tandem.

The advantage offered by the first aspect of the present invention is as follows. When the torque of an external driving-power source is transmitted to the driving bevel gear, the driving bevel gear rotates. The rotation is transmitted through a plurality of transmission mechanisms to the rolls. Thus the rolls rotate to roll a workpiece. Because the input-shaft mechanism is disposed between adjacent two transmission mechanisms, the angles between the input-shaft mechanism and the two transmission mechanisms can be set freely so long as they do not interfere with each other. In other words, the phase angle of the roll unit can freely be changed while the input shaft is kept horizontal. Therefore, by arranging a number of rolling mills of this aspect in tandem, a rolling-mill train with roll phase angles minutely different from one another can be made.

The advantages offered by the second aspect of the present invention are as follows. The rotational torque of the driving bevel gear is transmitted to the rolls through the first cylindrical gear of the first transmission shaft and the second cylindrical gear of the second transmission shaft, engaging with each other, of each transmission mechanism; therefore the driving force can be utilized efficiently with a small transmission loss. Besides, because the transmission mechanisms are compact, they are less likely to interfere with the input-shaft mechanism; therefore the phase angle of the transmission mechanisms and hence that of the roll unit can be adjusted in a large range.

The advantage offered by the third aspect of the present invention is as follows. The input shaft takes the place of the first transmission shaft in one of the transmission mechanisms and torque is transmitted from the input shaft to the second transmission shaft through the first and second cylindrical gears engaging with each other. Accordingly the rolls can be disposed horizontally and vertically with the input shaft disposed horizontally and in parallel with the second transmission shaft.

The advantage offered by the fourth aspect of the present invention is as follows. The rotational torque of the input shaft is transmitted to the second transmission shaft through the first and second bevel gears. By changing the diameters of the first and second bevel gears, the angle between the input shaft and the second transmission shaft can be changed freely. Accordingly while the input shaft is kept horizontal, the phase angle of the roll unit can be changed freely. Therefore, by arranging a number of rolling mills of this aspect in tandem, a rolling-mill train with roll phase angles minutely different from one another can be made.

The advantages offered by the fifth aspect of the present invention are as follows. Because the rolling-mill train consists of rolling mills with roll phase angles minutely different from one another, a workpiece can be rolled in many different directions; accordingly high rolling accuracy can be achieved and the inner surfaces of pipes can be prevented from becoming squarish. Because the input shafts of all the rolling mills are disposed horizontally, the coupler portions with reducers are not bulky. Moreover, it is not necessary to provide reducers with a transmission bevel gear; therefore they do not become bulky.

The advantages offered by the sixth aspect of the present invention are as follows. Because the rolling-mill train consists of rolling mills with roll phase angles minutely different from one another, a workpiece can be rolled in many different directions; accordingly high rolling accuracy can be achieved and the inner surfaces of pipes can be prevented from becoming squarish. Because the input shafts of the rolling mills in the train are disposed horizontally whereas their rolls are slanted, the couplers with their reducers are not bulky.

The advantages offered by the seventh aspect of the present invention are as follows. Because a rolling mill with horizontal and vertical rolls and a plurality of rolling mills with roll phase angles minutely different from one another are arranged in tandem, the rolling accuracy is high and the inner surfaces of pipes can be prevented from becoming squarish. In addition, because all the input shafts are horizontal, the couplers with their reducers are not bulky.

BRIEF DESCRIPTION OF THE DRAWINGS

The features and advantages of the present invention will become more clearly appreciated from the following description in conjunction with the accompanying drawings, in which.

DETAILED DESCRIPTION OF THE PREFERRED EMBODIMENTS

Figure 1:
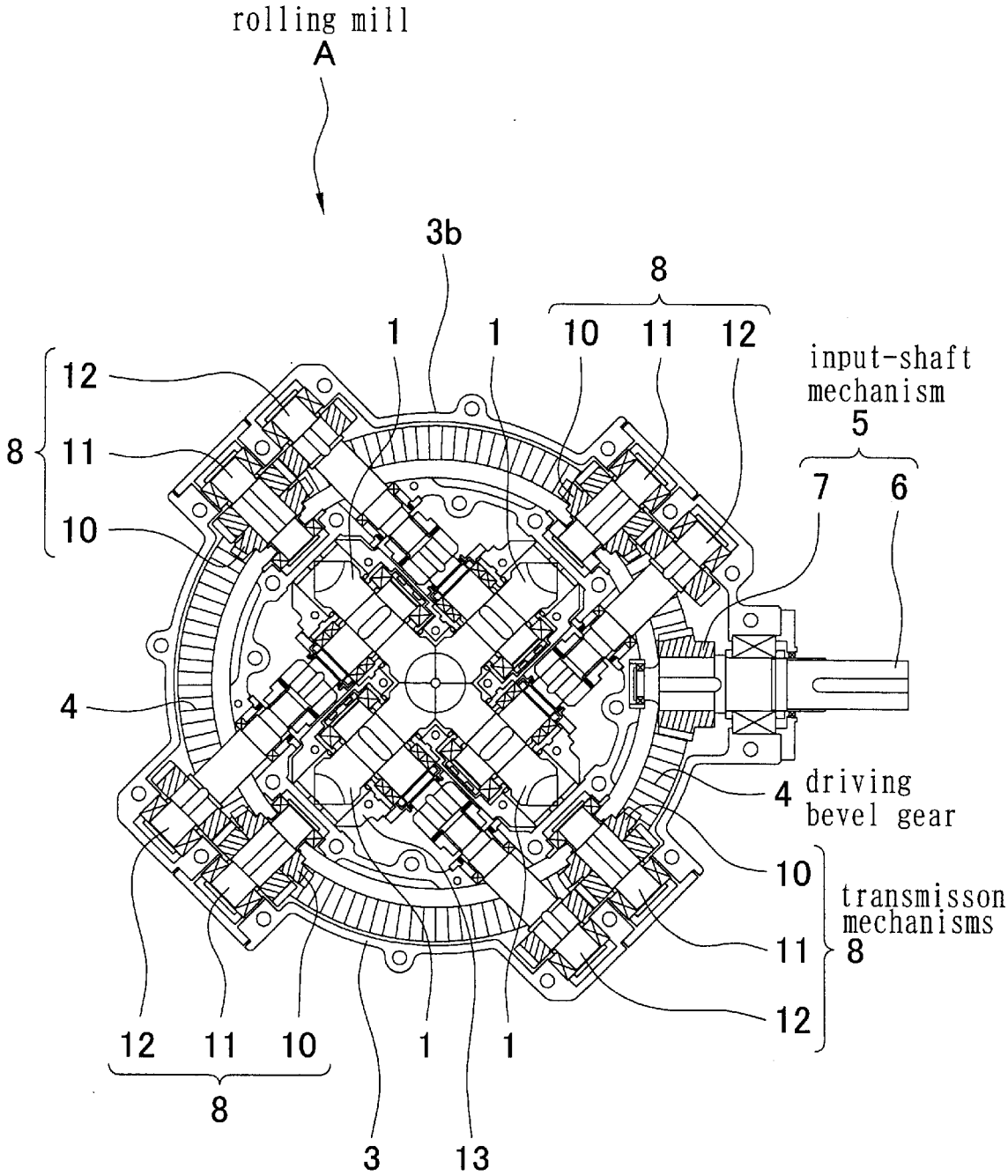
FIG. 1 is a front view of an embodiment of rolling mill "A" in accordance with the first and second aspects of the present invention, its front section removed.

Referring to the drawings, preferred embodiments of the present invention will now be described.

Figure 2:
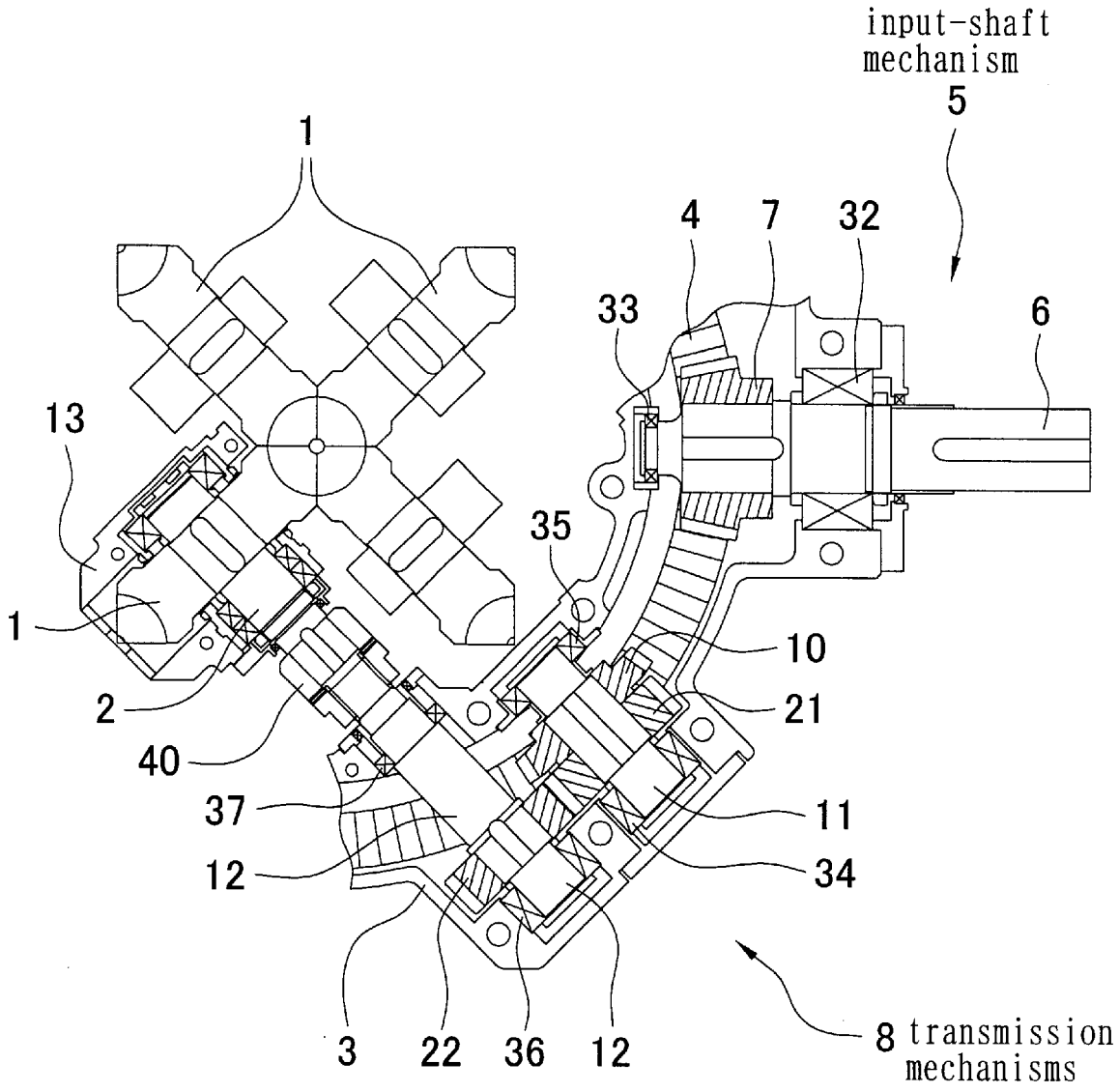
FIG. 2 is an enlarged view of part of the rolling mill "A" of FIG. 1.

Referring to FIGS. 1 and 2, the basic construction of the rolling mill "A" will be described first.

The rolling mill "A" is of a four-roll type, having a pair of slant rolls 1 and 1 disposed opposite to each other and another pair of slant rolls 1 and 1 disposed opposite to each other, the latter pair disposed orthogonally relative to the former pair. The four rolls 1 are arranged at 90° intervals around the pathline of the rolling mill "A", and a workpiece is rolled and formed in their grooves. A shaft 2 is fixed to the center of each roll 1. Reference numeral 3 is an annular outer housing, which holds a driving bevel gear 4, transmission mechanisms 8, etc. to be described later. The outer housing 3 is split into a front section 3*a* (removed in FIG. 1) and a rear section 3*b*. The outer housing 3 will be described in detail later, referring to FIG. 3.

The four rolls 1 are held by an inner housing, which is accommodated in the outer housing 3.

The outer housing 3 is generally annular. The large-diameter driving bevel gear 4 is disposed in the outer housing 3. The outer diameter of the driving bevel gear 4 is slightly smaller than the inner diameter of the outer wall of the outer housing 3, and the outer housing 3 is centered about the pathline. Therefore, the outer housing 3 is considerably large. The inner diameter of the driving bevel gear 4 is larger than the distance between outermost points of the four rolls 1.

Reference numeral 5 is an input-shaft mechanism comprising an input shaft 6 and an input bevel gear 7 fixed onto the input shaft 6. When the input shaft 6 is rotated by a motor and a reducer (both not shown), the driving bevel gear 4 rotates about the pathline of the rolling mill "A".

Reference numeral 8 indicates transmission mechanisms. Each transmission mechanism 8 comprises a transmission bevel gear 10 engaging with the driving bevel gear 4, a first transmission shaft 11, a second transmission shaft 12, etc. Each roll 1 is provided with one transmission mechanism 8; therefore there are four transmission mechanisms 8 in total. When the driving bevel gear 4 is rotated by the input-shaft mechanism 5, the torque of the driving bevel gear 4 is transmitted to the transmission mechanisms 8 and the rolls 1 are rotated.

Next the details of the rolling mill "A" will be described.

Figure 3:
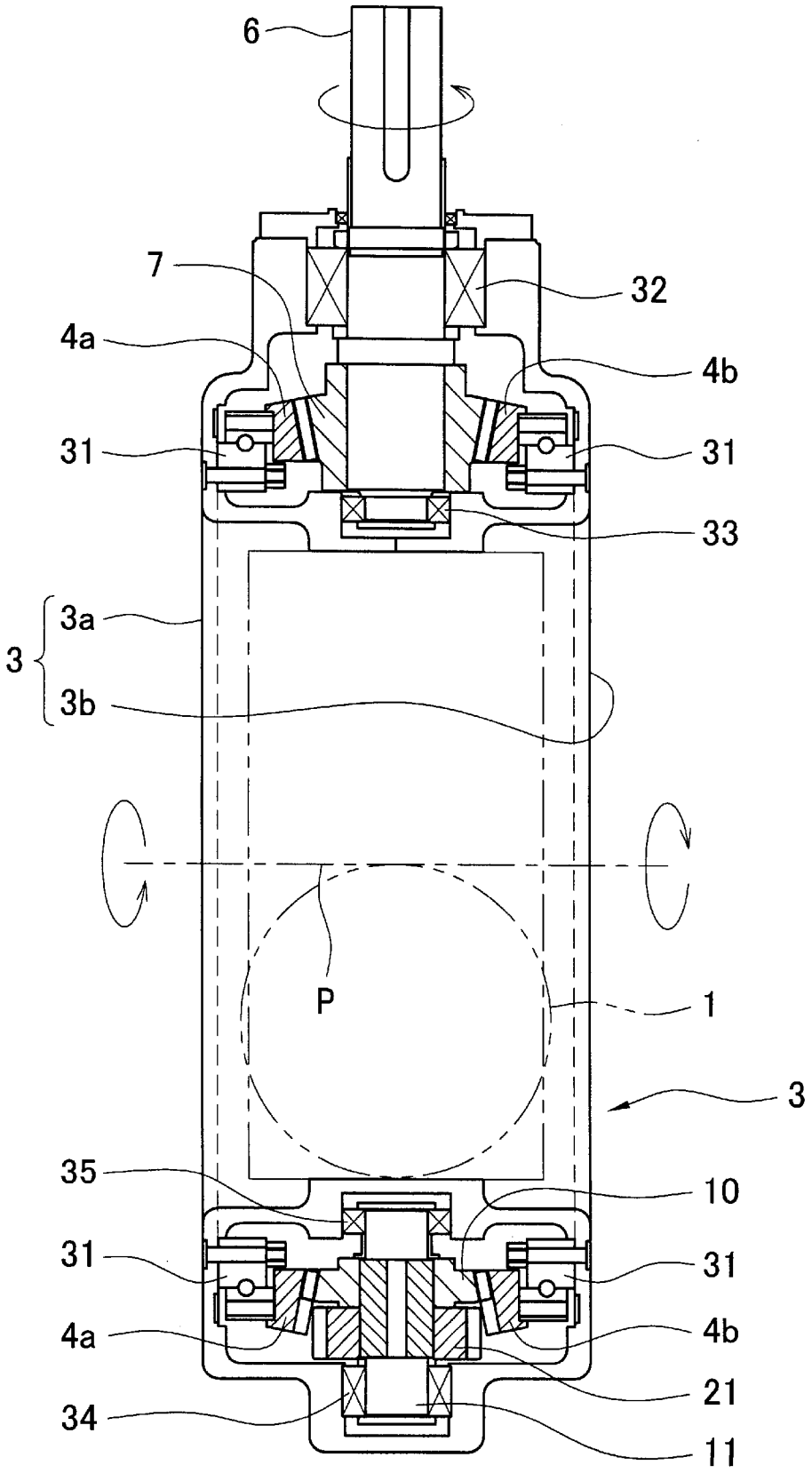
FIG. 3 is a transverse sectional view of the rolling mill "A" of FIG. 1.
Figure 6:
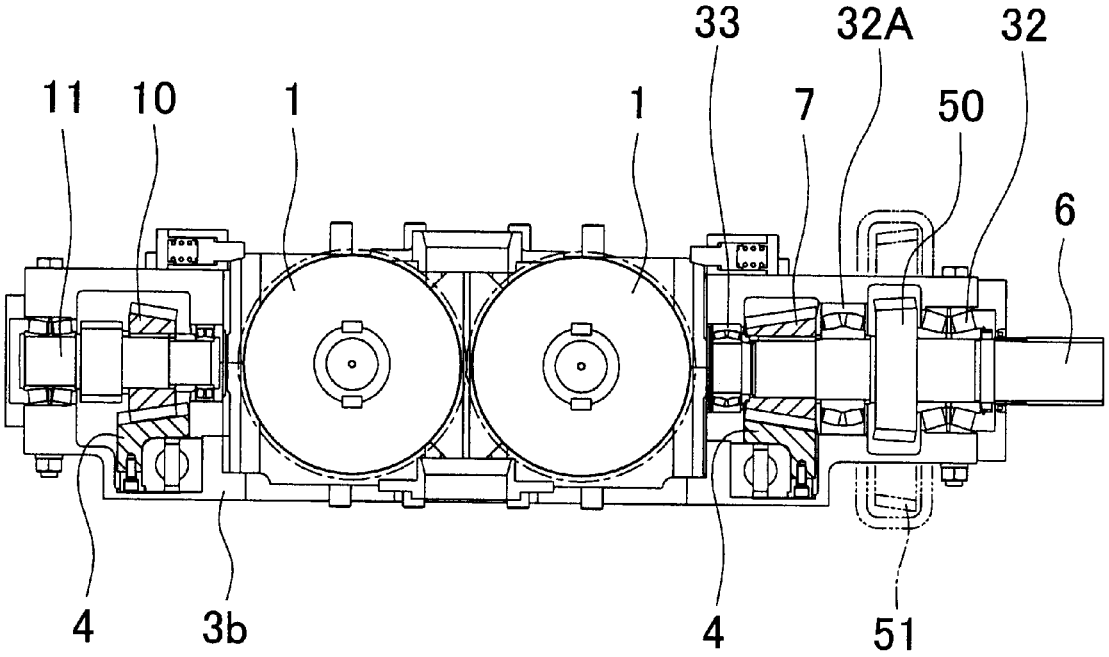
FIG. 6 is a transverse sectional view of the rolling mill "C" of FIG. 5.

As shown in FIGS. 2 and 3, the outer housing 3 is split into the front section 3*a* and the rear section 3*b*. A front driving bevel gear 4*a* and a rear driving bevel gear 4*b* are journaled on bearings 31 in the front section 3*a* and the rear section 3*b*, respectively. Although two driving bevel gears 4*a* and 4*b* are used in FIGS. 3, either the front or the rear driving bevel gear alone may be used if it can bear the torque transmitted through it. FIG. 6 shows an embodiment wherein a single driving bevel gear 4 is used.

The middle part and the front end of the input shaft 6 are supported by a bearing 32 and a bearing 33 so as to be freely rotatable relatively to the outer housing 3. The input bevel gear 7 fixed onto the input shaft 6 engages with and drives the single driving bevel gear 4 or the two driving bevel gears 4*a* and 4*b*.

Referring to FIG. 2, the transmission mechanism 8 will be described in detail below.

The first transmission shaft 11 is journaled in bearings 34 and 35. The transmission bevel gear 10 of a small diameter and a first cylindrical gear 21 are mounted on the first transmission shaft 11. Because the transmission bevel gear 10 is driven by the driving bevel gear 4, when the driving bevel gear 4 turns, the first transmission shaft 11 is rotated.

On the other hand, the second transmission shaft 12 is disposed in parallel with the first transmission shaft 11 and journaled in bearings 36 and 37.

A second cylindrical gear 22 is mounted on the second transmission shaft 12 and engages with the first cylindrical gear 21. The second transmission shaft 12 is coupled with a roll shaft 2 by a coupling 40.

The first and second cylindrical gears 21 and 22 may be spur wheels or helical gears. The bearings 34 to 37 are held by the outer housing 3.

This embodiment having the above configuration, when the rotational power of a motor (not shown) is transmitted through a reducer to the input shaft 6, the driving bevel gear 4 rotates. The rotation of the driving bevel gear 4 is transmitted through the four transmission mechanisms 8 to the four rolls 1, and all the four rolls 1 rotate.

In this embodiment, the input-shaft mechanism 5 can be mounted on the outer housing 3, between any two adjacent transmission mechanisms 8, with any angle between the input shaft 6 and the first and second transmission shafts 11 and 12 of the transmission mechanisms 8. The mounting angle of the input-shaft mechanism 5 is about 20° to 70° relative to an adjacent transmission mechanism 8 in order to avoid its interference with the adjacent two transmission mechanisms 8.

Figure 7:
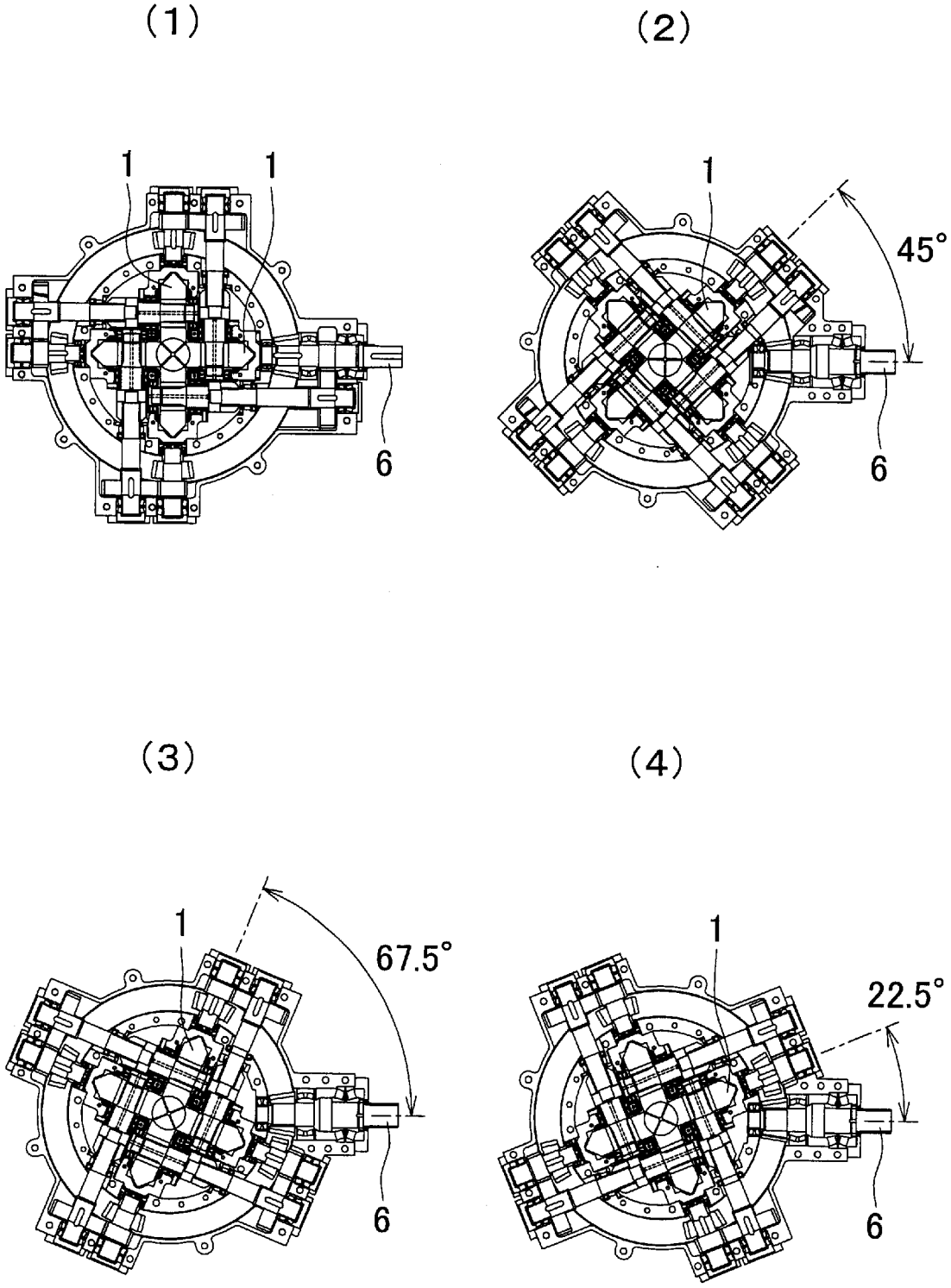
FIG. 7 shows the rolling mills "A" and "B" with different roll phase angles.

The angle between the input shaft 6 and an adjacent roll 1 is set at 45°, 67.5°, and 56.25° in FIGS. 7(2), 7(3), and 8(5), respectively. The rolling mill "A" in FIG. 7(3) is turned upside down in FIG. 7(4) to have an angle of 22.5°. The rolling mill "A" in FIG. 8(5) is turned upside down in FIG. 8(6) to have an angle of 33.75°.

According to this embodiment, the phase angle of the roll unit can be adjusted minutely as described above; therefore high rolling accuracy can be secured. Besides, when a pipe is rolled, the inner surface can effectively be prevented from becoming squarish. Moreover, because the input shaft 6 can be disposed horizontally as shown by the above examples, the bulk and the height of the coupler portion between the rolling mill "A" and its reducer can be kept small; therefore the whole rolling equipment can be made low and compact.

Figure 4:
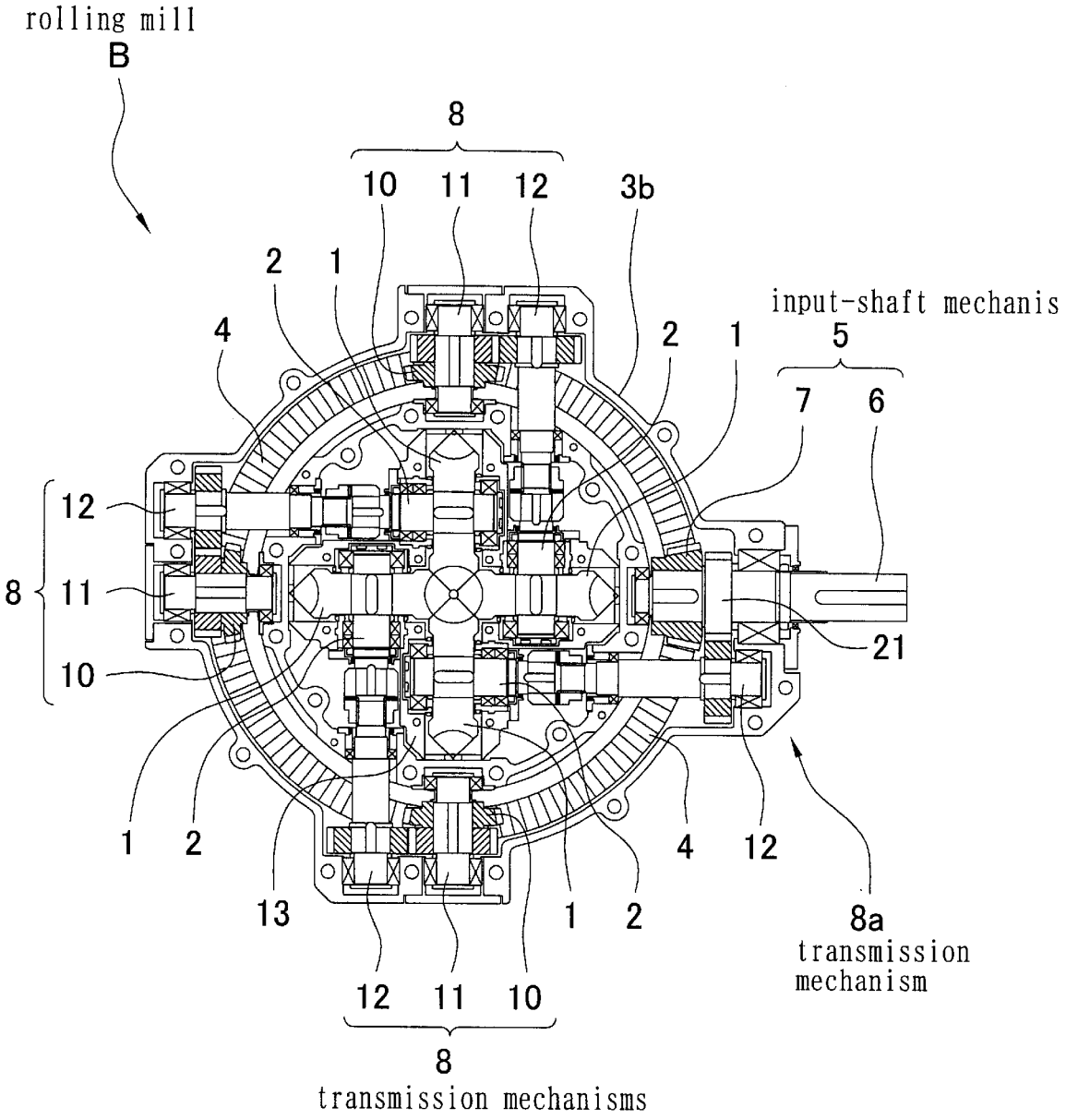
FIG. 4 is a front view of an embodiment of rolling mill "B" in accordance with the third aspect of the present invention, its front section removed.

Next an embodiment of rolling mill "B" in accordance with the third aspect of the present invention will be described. FIG. 4 is a front view of the rolling mill "B", its front section removed.

The rolling mill "B" has four rolls 1 disposed horizontally and vertically. As the result, although transmission mechanisms 8 for three rolls 1 may be of the same configuration as those of the rolling mill "A", a transmission mechanism 8*a* for one horizontal roll 1 can be provided with an second transmission shaft 12 but not be provided with an first transmission shaft because it interferes with an input shaft 6 for the rolling mill "B". Accordingly the transmission mechanism Ba is not provided with a first transmission shaft. In the transmission mechanism 8*a*, an input bevel gear 7 and a first cylindrical gear 21 are mounted on the input shaft 6 and driving force is transmitted from the first cylindrical gear 21 to the second transmission shaft 12.

With the above configuration, when the driving bevel gear 4 turns, the four rolls 1 rotate.

Figure 5:
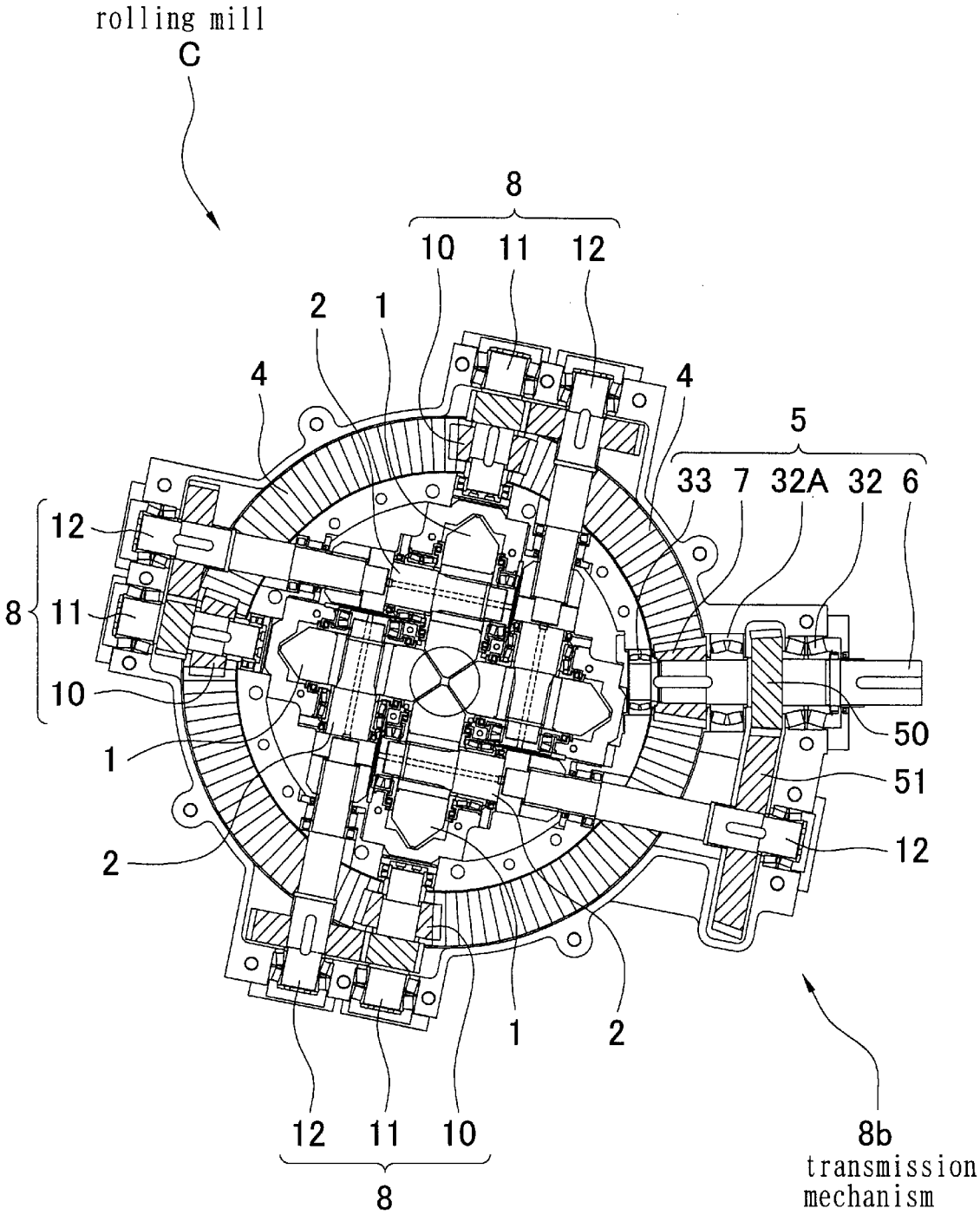
FIG. 5 is a front view of an embodiment of rolling mill "C" in accordance with the fourth aspect of the present invention, its front section removed.

When the input shaft 6 of the rolling mill "B" is disposed horizontally, the four rolls 1 are disposed horizontally and vertically as shown in FIG. 7(1). When a number of rolling mills "A" and a rolling mill "B" are combined, a rolling-mill train with horizontal input shafts and six roll phase angles can be constituted. Next an embodiment of rolling mill "C" in accordance with the fourth aspect of the present invention will be described. FIG. 5 is a front view of the rolling mill "C", its front section removed. FIG. 6 is a transverse sectional view of the rolling mill "C" of FIG. 5.

Four rolls 1, a driving bevel gear 4, and three transmission mechanisms 8 for three rolls 1 are the same as those of the rolling mill "B" of FIG. 4. As shown in FIG. 6, rolling mill "C" has a single driving bevel gear 4.

In the rolling mill "C", a transmission mechanism 8*b* for a horizontal roll 1 has an input shaft 6, on which an input bevel gear 7 and a first transmission bevel gear 50 are mounted. The transmission mechanism 8*b* has also a second transmission shaft 12, on which a second bevel gear 51 is mounted. Torque is transmitted through the first and second bevel gears 50 and 51. The input shaft 6 of the rolling mill "C" is the same as those of the rolling mills "A" and "B" in that it is supported at its front end by the bearing 33 and at the part behind the first bevel gear 50 by the bearing 32. However, the former input shaft 6 is different from the latter input shafts 6 in that the former is also supported at the part between the input bevel gear 7 and the first bevel gear 50 by a third bearing 32A. However either the two-point or the three-point supporting may be adopted as the occasion demands.

According to this embodiment, the angle between the input shaft 6 and the second transmission shaft 12 (and hence the roll 1 coupled with it) can be changed by changing the diameters of the first bevel gear 50 and the second bevel gear 51. Namely, although the angle is 11.25° in FIG. 5, it can be enlarged by enlarging the diameters of the first bevel gear 50 and the second bevel gear 51 and reduced by reducing the same.

Figure 8:
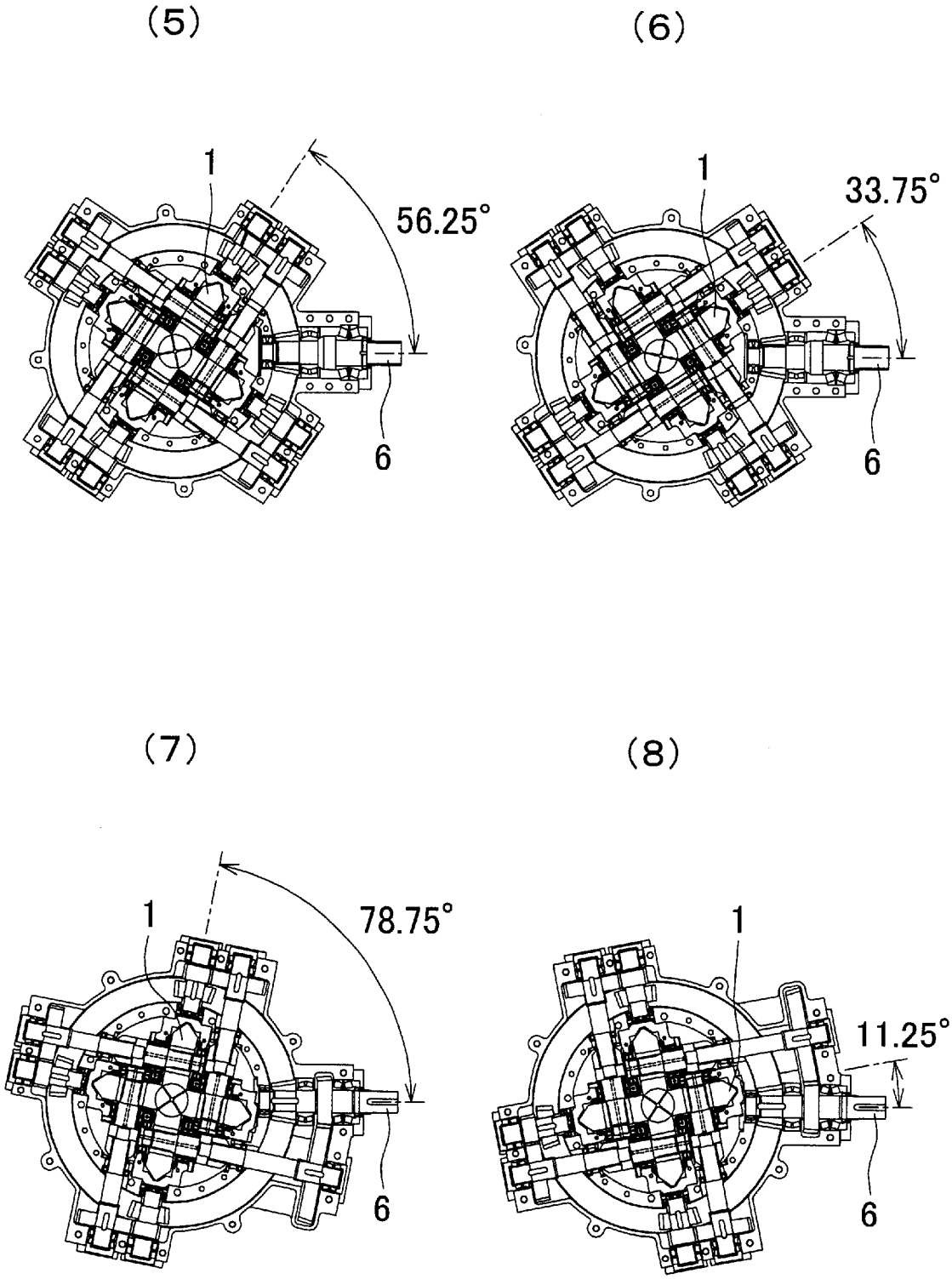
FIG. 8 shows the rolling mills "B" and "C" with different roll phase angles.
Figure 9:
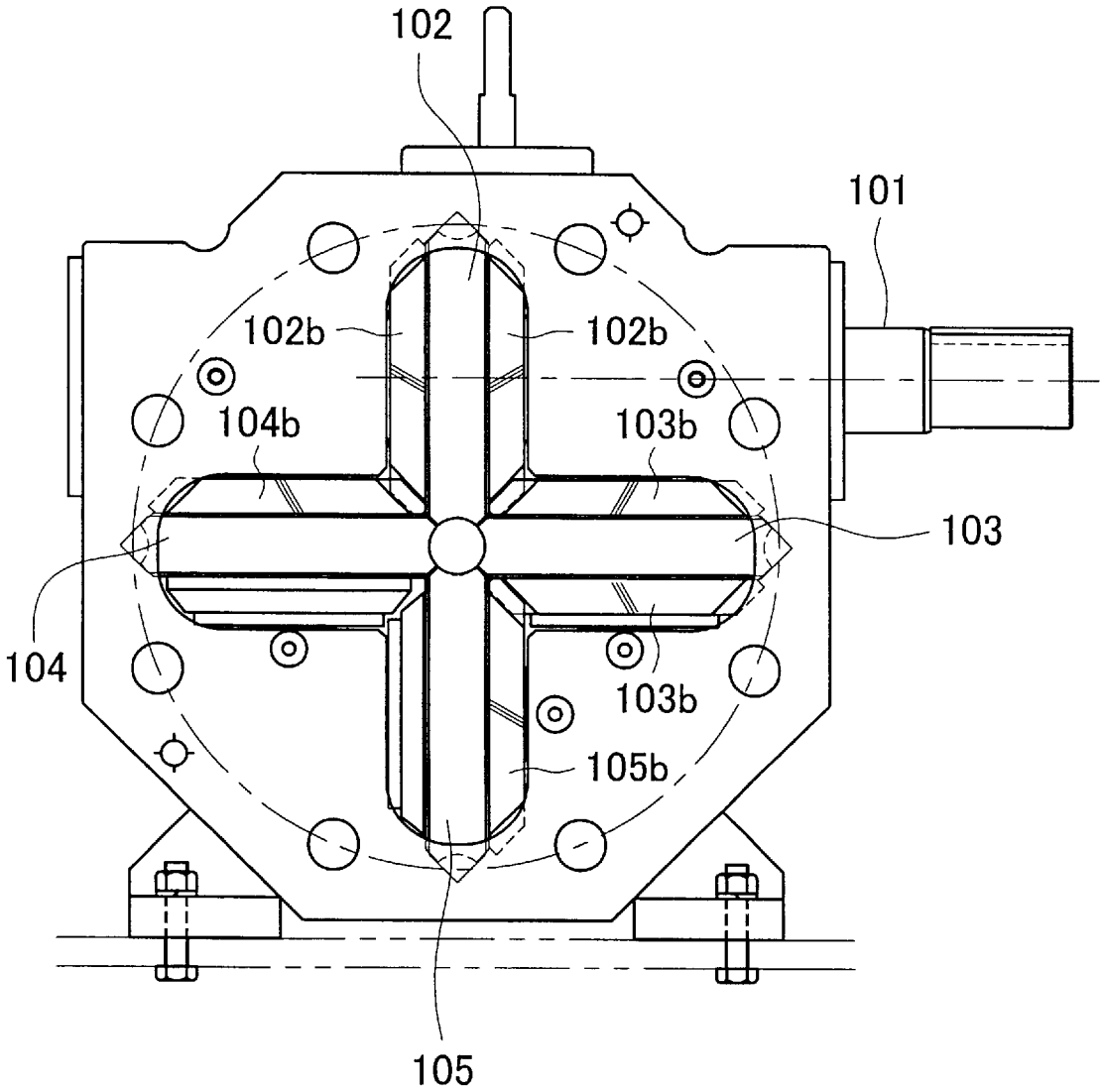
FIG. 9 PRIOR ART
FIG. 9 is a front view of a four-roll rolling mill with vertical and horizontal rolls in accordance with the prior art.
Figure 10:
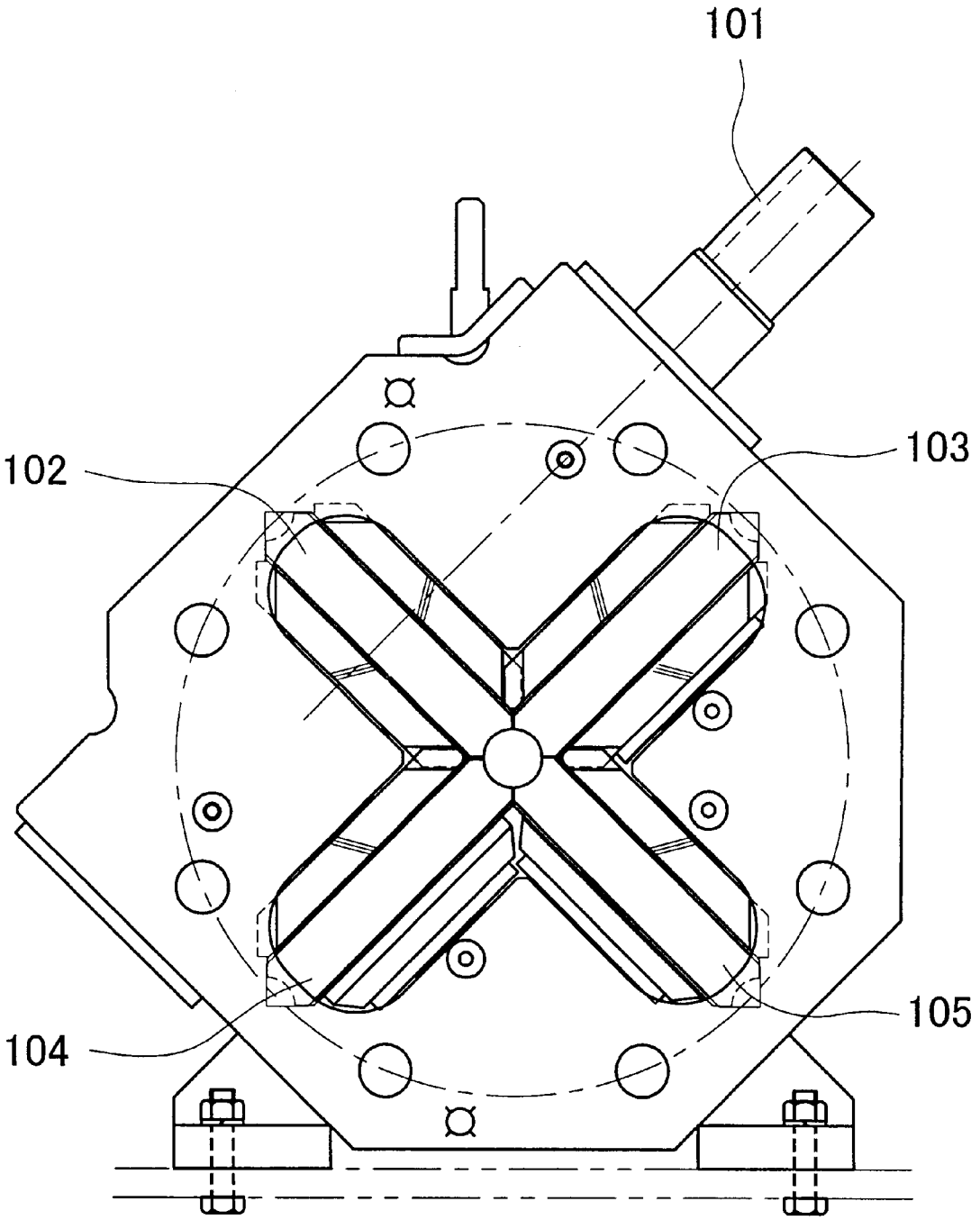
FIG. 10 PRIOR ART
FIG. 10 is a front view of a four-roll rolling mill with slant rolls in accordance with the prior art.

FIG. 8(7) shows the rolling mill "C" of FIG. 5 with its input shaft 6 disposed horizontally and a roll phase angle of 78.75° FIG. 8(8) shows the rolling mill "C" of FIG. 8(7) which is turned upside down to be given a roll phase angle of 11.25°.

Accordingly, by combining all the rolling mills "A", "B", and "C" tandem, a rolling-mill train with many roll phase angles minutely different from one another can be made.

Although the above embodiments are all for four-roll rolling mills, three-roll rolling mills can be constituted by using transmission mechanisms 8 and input-shaft mechanisms 5. Namely, three rolls are arranged at 120° intervals around the pathline, three transmission mechanisms 8 are disposed for the three rolls, and they are driven by a driving bevel gear 4. The input shaft of the input-shaft mechanism of the three-roll rolling mill can be disposed horizontally; therefore the coupler with its reducer is not bulky.

The invention may be embodied in other specific forms without departing from the spirit or essential characteristics thereof. The above embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What we claim is:

1. A rolling mill comprising:

a roll unit including a plurality of rolls disposed symmetrically around the pathline of the rolling mill; and a driving unit for driving and rotating the rolls, the driving unit having an annular driving bevel gear of a large diameter, an input-shaft mechanism for rotating the driving bevel gear, a plurality of transmission mechanisms disposed at regular intervals along the driving bevel gear and transmitting the rotation of the driving bevel gear to the rolls, and a housing for holding them, the input-shaft mechanism (i) having an input shaft inserted in the housing from its outside and an input bevel gear of a small diameter mounted on the input shaft and engaging with the driving bevel gear and (ii) disposed between two adjacent transmission mechanisms.

2. A rolling mill as claimed in claim 1, wherein each transmission mechanism comprises:

a first transmission shaft on which mounted is a transmission bevel gear of a small diameter engaging with the driving bevel gear;

a first cylindrical gear mounted on the first transmission shaft;

a second transmission shaft coupled with a shaft of a roll; and a second cylindrical gear mounted on the second transmission shaft and engaging with the fist cylindrical gear.

3. A rolling mill as claimed in claim 2, wherein:

the input shaft of the input-shaft mechanism takes the place of the first transmission shaft of one of the transmission mechanisms and is disposed in parallel with the second transmission shaft; and the first cylindrical gear is mounted on the input shaft and engages with the second cylindrical gear of the second transmission shaft.

4. A rolling mill as claimed in claim 3, wherein:

a first bevel gear takes the place of the first cylindrical gear of the input shaft; and a second bevel gear takes the place of the second cylindrical gear of the second transmission shaft.

5. A rolling-mill train comprising a plurality of rolling mills of claim 1, their input shafts being disposed horizontally, the phase angles of their roll units being different from one another.

6. A rolling-mill train comprising a plurality of rolling mills of claim 4, their input shafts being disposed horizontally, the phase angles of their roll units being different from one another.

7. A rolling-mill train comprising the rolling mill of claim 3 with its input shaft disposed horizontally, the rolling-mill train of claim 5, and the rolling-mill train of claim 6 all arranged in tandem.

* * * * *